US008911219B2

(12) United States Patent
Walter et al.

(10) Patent No.: US 8,911,219 B2
(45) Date of Patent: Dec. 16, 2014

(54) SUBMERSIBLE WATER CIRCULATION SYSTEM FOR ENCLOSED TANKS

(75) Inventors: Douglas P. Walter, Dickinson, ND (US); Joel J. Bleth, Dickinson, ND (US); Willard R. Tormaschy, Dickinson, ND (US); Corey M. Simnioniw, Belfield, ND (US); Jonathan L. Zent, Dickinsno, ND (US)

(73) Assignee: Medora Environmental, Inc., Dickinson, ND (US)

( * ) Notice: Subject to any disclaimer, the term of this patent is extended or adjusted under 35 U.S.C. 154(b) by 290 days.

(21) Appl. No.: 13/238,934

(22) Filed: Sep. 21, 2011

(65) Prior Publication Data

US 2013/0068326 A1 Mar. 21, 2013

(51) Int. Cl.

| | |
|---|---|
| ***F04B 17/00*** | (2006.01) |
| ***F04B 35/00*** | (2006.01) |
| ***F04B 23/00*** | (2006.01) |
| ***F04B 41/00*** | (2006.01) |
| ***B05B 1/20*** | (2006.01) |
| ***B05B 1/14*** | (2006.01) |
| ***B63H 11/103*** | (2006.01) |
| ***E03B 11/00*** | (2006.01) |

(52) U.S. Cl.

CPC ..... *E03B 11/00* (2013.01)
USPC ..... 417/423.3; 417/423.14; 417/360; 440/47; 239/558; 239/566

(58) Field of Classification Search

USPC ..... 417/360, 423.3, 423.14; 440/38, 39, 47; 239/566, 558

See application file for complete search history.

(56) References Cited

U.S. PATENT DOCUMENTS

| | | | | |
|---|---|---|---|---|
| 2,116,863 | A * | 5/1938 | Dinley | 239/594 |
| 3,234,885 | A * | 2/1966 | Englesson | 415/126 |
| 3,880,553 | A * | 4/1975 | Wolford et al. | 417/360 |
| 4,403,923 | A * | 9/1983 | Korchin | 417/360 |
| 4,421,788 | A * | 12/1983 | Kramer | 427/136 |
| 4,726,742 | A * | 2/1988 | Harbison et al. | 417/360 |
| 4,912,782 | A * | 4/1990 | Robbins | 4/678 |
| 5,226,935 | A * | 7/1993 | Wolff et al. | 96/262 |
| 7,332,074 | B2 | 2/2008 | Tormaschy | |
| 7,517,460 | B2 * | 4/2009 | Tormaschy et al. | 210/754 |
| 7,670,044 | B2 | 3/2010 | Tormaschy | |
| 7,713,031 | B2 * | 5/2010 | Dane | 417/61 |
| 7,850,433 | B2 | 12/2010 | Tormaschy | |
| 7,906,017 | B2 | 3/2011 | Tormaschy | |
| 2004/0018104 | A1 * | 1/2004 | Watkins | 417/423.3 |
| 2010/0236647 | A1 * | 9/2010 | Simnioniw et al. | 137/565.01 |

* cited by examiner

*Primary Examiner* — Bryan Lettman
*Assistant Examiner* — Timothy P Solak
(74) *Attorney, Agent, or Firm* — W. Scott Carson

(57) ABSTRACT

A submersible, water circulation system for enclosed tanks such as used by municipalities, fire districts, and industries. The system includes a driving unit having a shell extending along an axis with a pump supported within the shell. The shell has at least one inlet and at least one outlet and is positionable on the floor of the tank with the outlet facing upwardly. In operation, the pump continuously draws an incoming flow of water from outside of the driving unit adjacent the tank floor through the inlet of the driving unit and preferably drives all of the continuously incoming flow out through the upwardly facing outlet. The upwardly facing outlet is preferably a thin, elongated slot that creates a thin, substantially planar discharge of water therethrough that presents a very large surface area for its volume and induces water adjacent the shell to move upwardly with it.

23 Claims, 9 Drawing Sheets

SUBMERSIBLE WATER CIRCULATION SYSTEM FOR ENCLOSED TANKS

BACKGROUND OF THE INVENTION

1. Field of the Invention

This invention relates to the field of circulation systems for water tanks and more particularly to the field of circulation systems for enclosed tanks such as used for municipalities, fire protection, and industrial purposes.

2. Discussion of the Background

Municipalities, fire districts, and industries commonly use enclosed water tanks. Such tanks typically hold about 300,000-500,000 gallons with some larger ones more on the order of 2 to 3 million gallons and are about 50-75 feet wide and 30 or more feet high. The water in these tanks is preferably kept mixed by an internal circulation system to maintain its freshness, particularly in municipal water tanks, and to avoid water quality problems such as bacteria growth and nitrite development.

A physical problem with many such tanks is that they normally have only a relatively small access opening (e.g., 18-24 inches wide) which is designed primarily just to permit an individual worker to pass through to inspect or repair the tank. Consequently, many circulation systems if they are going to be used in the tank must be passed through the access opening in nearly completely disassembled or at least partially disassembled condition. One or more workers must then enter the tank to assemble the system. This often requires special, elaborate, and costly training and following strict regulatory and other safety procedures. Special equipment must also often be used such as winches to lower the workers, tethered tools, safety lines, air monitors, inflatable rafts, and even diving gear as well as rescue personnel standing by. Additionally, it can require that the tank be taken off line or out of service and even drained. Alternate sources must often then be arranged to temporarily supply water to customers and for fire protection. Any unexpected or prolonged delays in bringing the tank back on line can thereafter be quite costly and in some cases present safety concerns to the community. The same problems are presented if the circulation system placed in the tank subsequently breaks down and workers must enter the tank to repair it.

With these and other concerns in mind, the present invention was developed. In it, a submersible circulation system is provided that can easily fit through the relatively small access opening of the tank in a completely assembled condition. Additionally, the circulation system is designed to be lowered to the tank floor to automatically assume the desired operating orientation without the need for any workers to enter the tank. The system can also be raised out of the tank through the access opening without the necessity of any workers having to enter the tank.

SUMMARY OF THE INVENTION

This invention involves a submersible, water circulation system for enclosed tanks such as used by municipalities, fire districts, and industries. The system includes a driving unit having a shell extending along an axis with a pump supported within the shell. The shell has at least one inlet and at least one outlet and is positionable on the floor of the tank with the outlet facing upwardly.

In operation, the pump continuously draws an incoming flow of water from outside of the driving unit adjacent the tank floor through the inlet of the driving unit. In the preferred embodiment, all of the continuously incoming flow is then driven by the pump out of the driving unit through the upwardly facing outlet. The upwardly facing outlet is preferably a thin, elongated slot extending along the shell of the driving unit and creates a thin, substantially planar discharge of water therethrough that is directed upwardly toward the surface of the body of water. The substantially planar discharge induces water adjacent the outside of the shell of the driving unit to move upwardly with it toward the surface of the body of water.

The substantially planar discharge presents a very large surface area for its volume to the adjacent water and induces a very large volume of tank water to flow with it. The discharge from the submerged driving unit is substantially laminar and travels upwardly to the surface of the water and substantially radially outwardly to the sides of the tank. It then flows downwardly to the tank floor and substantially radially inwardly along the tank floor to the submerged driving unit. In doing so, this primary circulation pattern in turn induces secondary flow patterns within the body of water to thereby thoroughly mix the water in the entire tank and to do so in a substantially laminar manner.

The driving unit of the circulation system is additionally designed to be received through the relatively small access opening of the tank in a completely assembled conditioned. It can thereafter be lowered to the tank floor by a flexible line to automatically assume the desired operating orientation without the need for any workers to enter the tank. The driving unit can also be raised out of the tank through the access opening without the necessity of any workers having to enter the tank.

DETAILED DESCRIPTION OF THE INVENTION

Figure 1:
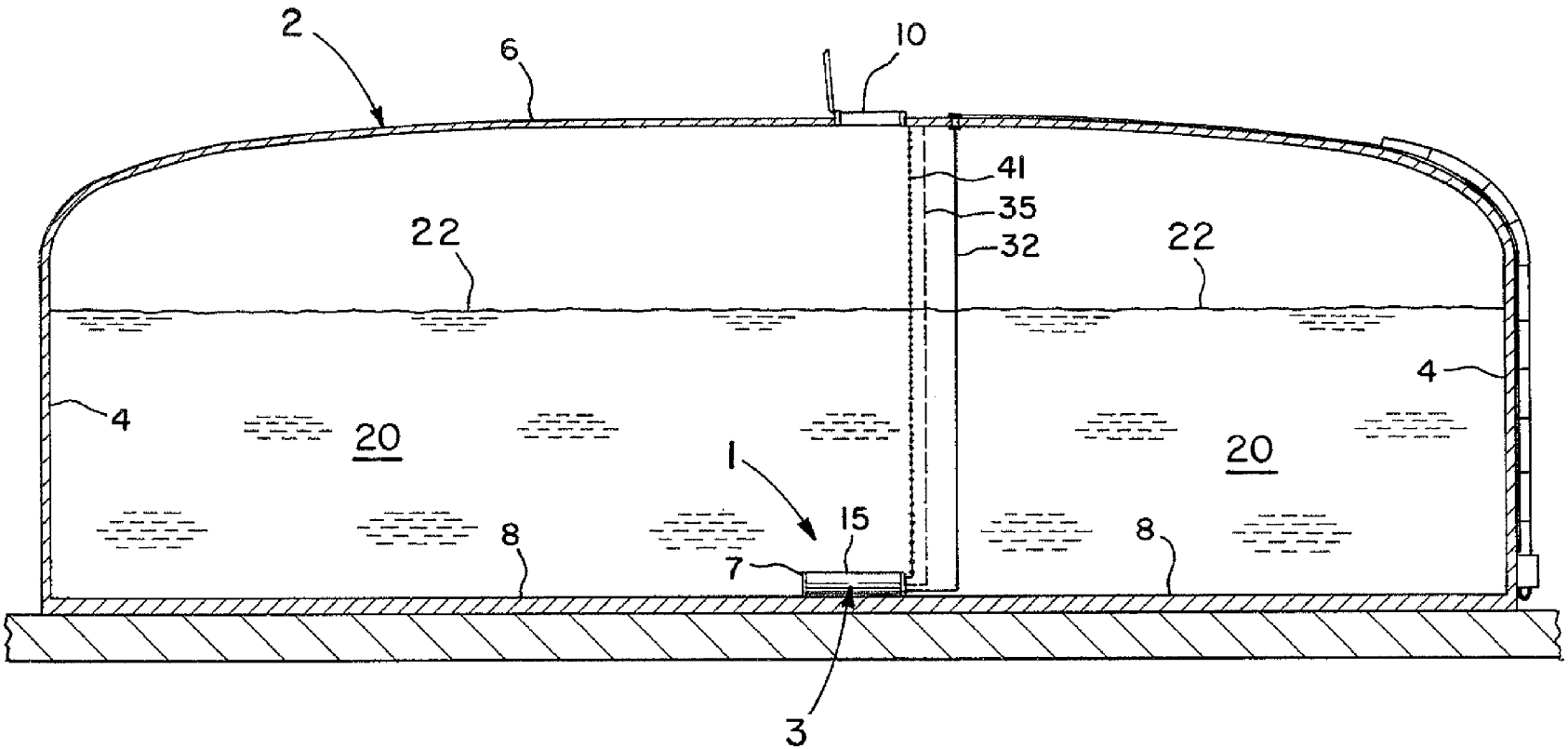
FIG. 1 illustrates the circulation system of the present invention in its operating position within a water tank.
Figure 2:
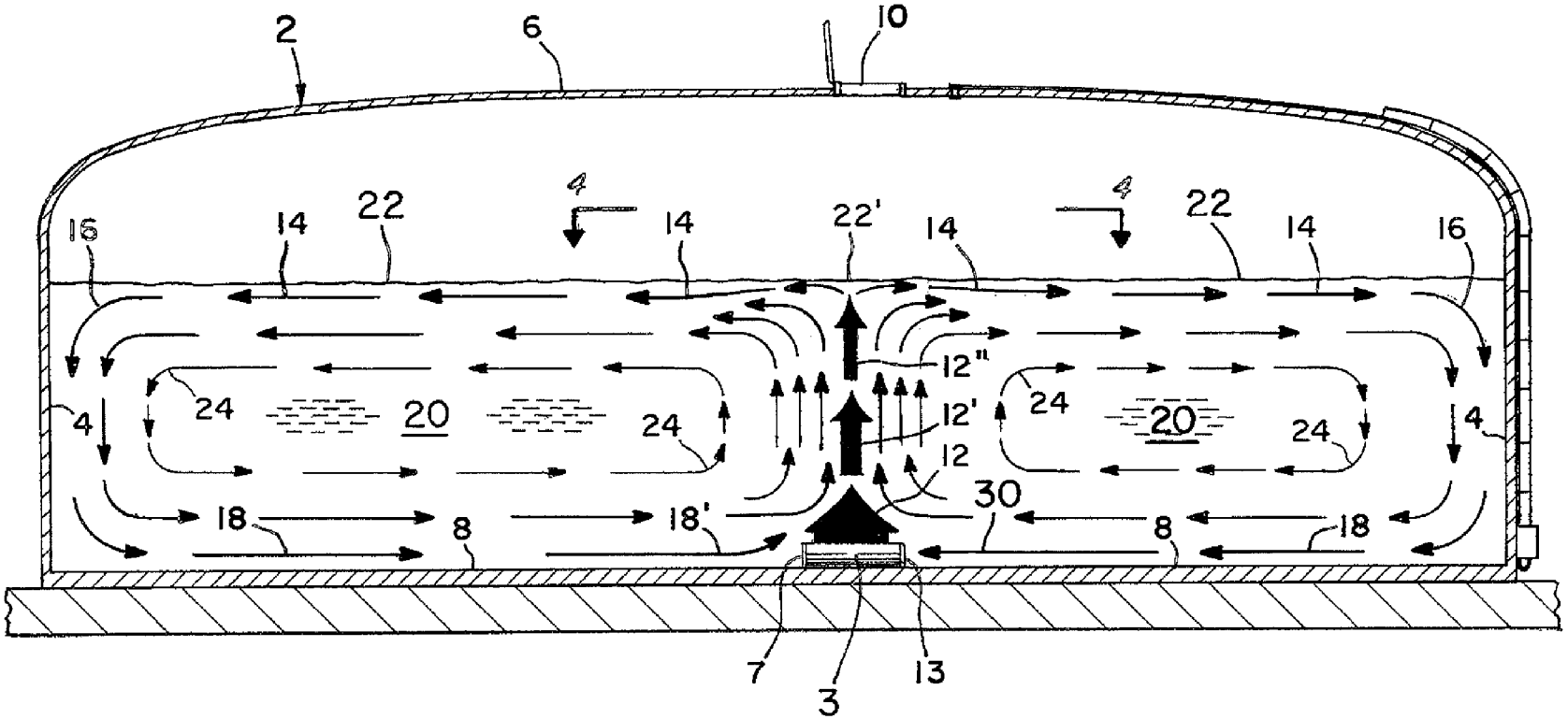
FIG. 2 is a view similar to FIG. 1 showing the substantially laminar flow created by the circulation system in the entire tank to thoroughly and completely mix the water.
Figure 3:
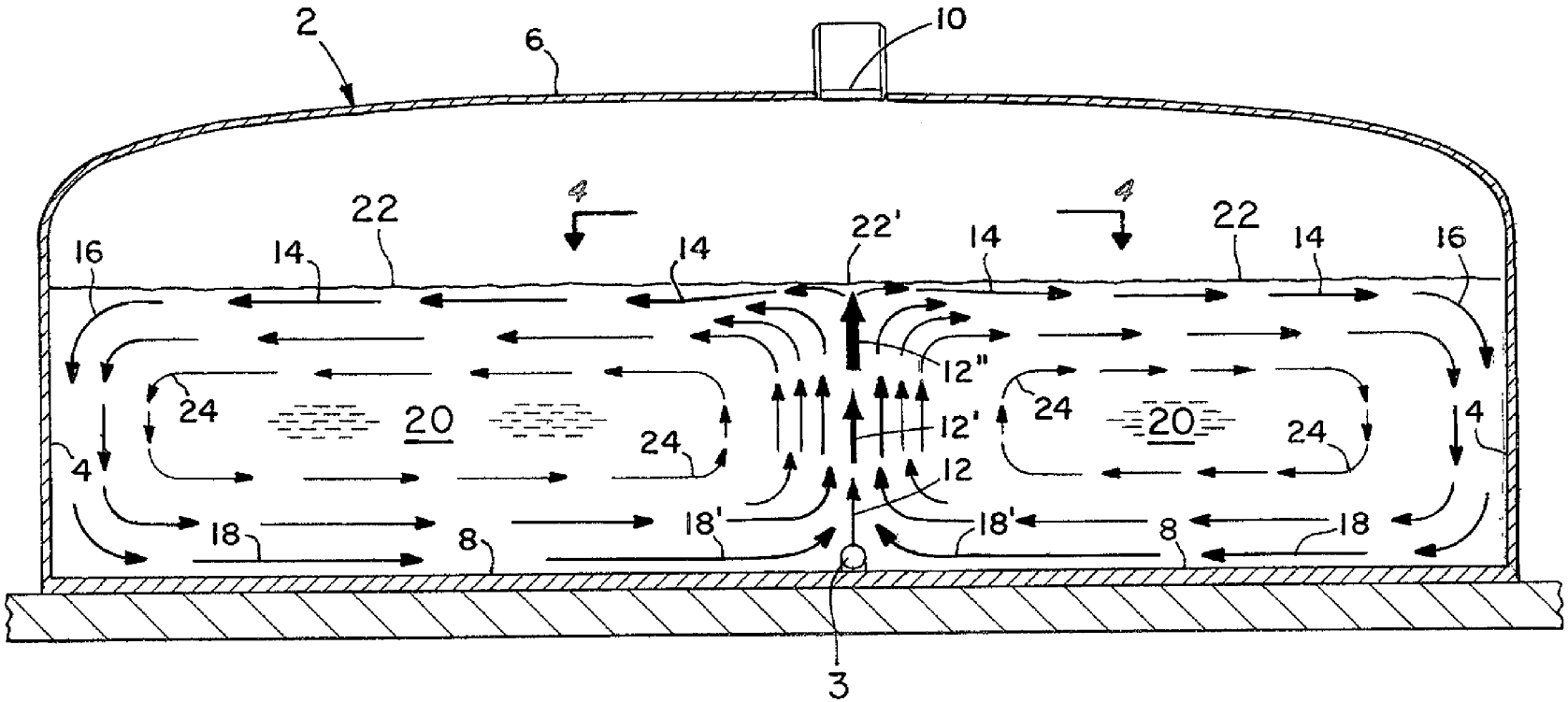
FIG. 3 is a view similar to FIG. 2 but taken at a right angle to it.

As shown in FIGS. 1-3, the circulation system 1 of the present invention is primarily intended for use to circulate water (FIGS. 2-3) in an enclosed water tank 2. Such tanks 2 are commonly used to contain water for municipalities, fire prevention, and industrial purposes. The tanks 2 (FIG. 1) typically have side and top walls 4,6 and a floor 8. The tank size can vary but typically holds about 300,000-500,000 gallons with some larger ones more on the order of 2 to 3 million gallons and are about 50-75 feet wide and 30 or more feet high. The tanks 2 also usually have a fairly small access opening at 10 (e.g., 18-24 inches wide) in the top wall 6 that is primarily designed to permit a single worker to pass through to inspect or repair the interior of the tank 2. In some cases, the access opening 10 may have safety bars or other restrictions and its width may be only 12 inches or less and not even permit any entry by a worker. The present circulation system 1 of FIGS. 1-3 in this last regard as explained in more detail below has been specifically designed to fit through such small access openings 10 in a completely assembled condition. Additionally, the circulation system 1 as also explained in more detail below has been designed so it can be lowered to the tank floor 8 to automatically assume the desired operating orientation of FIGS. 1-3 without the need for any workers to enter the tank 2. Conversely, the circulation system 1 of the present invention can be removed from the tank 2 through the access opening 10 without the necessity of any workers having to enter the tank 2.

Figure 4:
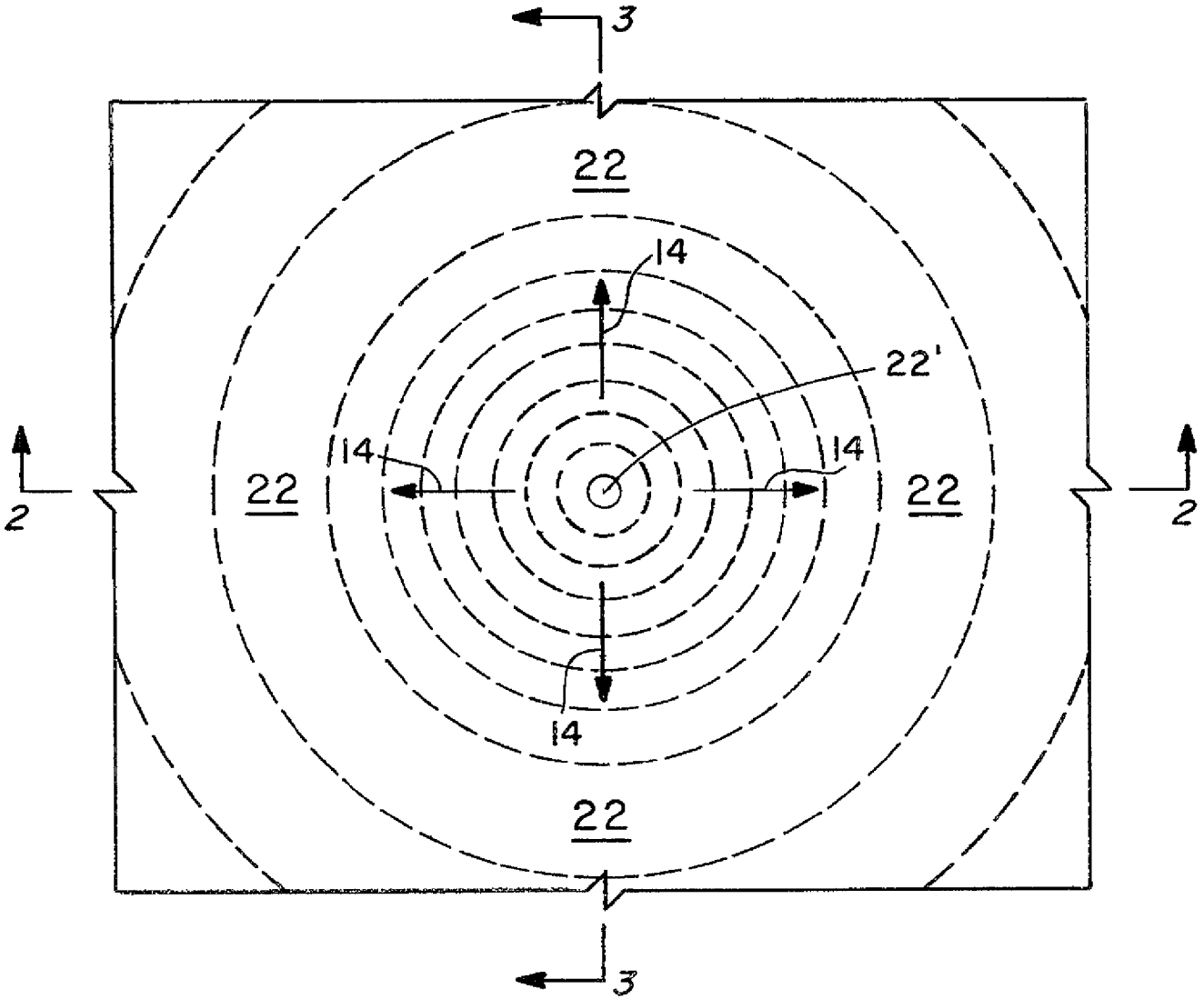
FIG. 4 is a top plan view taken along lines 4-4 of FIGS. 2 and 3 showing the nearly radial, surface spreading of the water as created by the circulation system

Referring again to FIGS. 1-3, the circulation system 1 has a submersible driving unit 3 (FIG. 1) positionable on the floor 8 of the tank 2. The driving unit 1 as illustrated in FIGS. 2-3 creates an upwardly directed flow 12,12',12" immediately above the drive unit 3 that establishes an overall circulation pattern 14,16,18 in the body of water 20 in the tank 2. In this regard, the overall circulation pattern extends upwardly at 12,12',12" from the submerged driving unit 3 to the surface 22 of the body of water 20 at 22'. The pattern then flows substantially radially outwardly at 14 (see FIGS. 2 and 4) along the surface 22 of the body of water 20 to the side walls 4 of the tank 2 (see again FIG. 2), downwardly at 16 along the tank walls 4, and substantially radially horizontally inwardly at 18 along the tank floor 8 toward the driving unit 3. Aiding the set up of this overall circulation pattern and in particular its radial surface spreading of FIG. 4 is that the upwardly directed flow 12,12',12" from the drive unit 3 preferably does not break or at least does not significantly break the surface 22. Rather, the upward flow creates a small mounding or crowning effect at 22' in FIGS. 2-3 (e.g., less than an inch and preferably a relatively small fraction such as ¼ to ½ of an inch). This mounding or crowning at 22' cyclically rises and collapses creating the substantially uniform, radial surface spreading of FIG. 4. Additionally, the overall circulation pattern of 12,12', 12" and 14,16,18 in the tank 2 in turn induces secondary flow patterns within the body of water 20 such as at 24 in FIG. 2 to then thoroughly mix the water in the entire tank 2.

Figure 6:
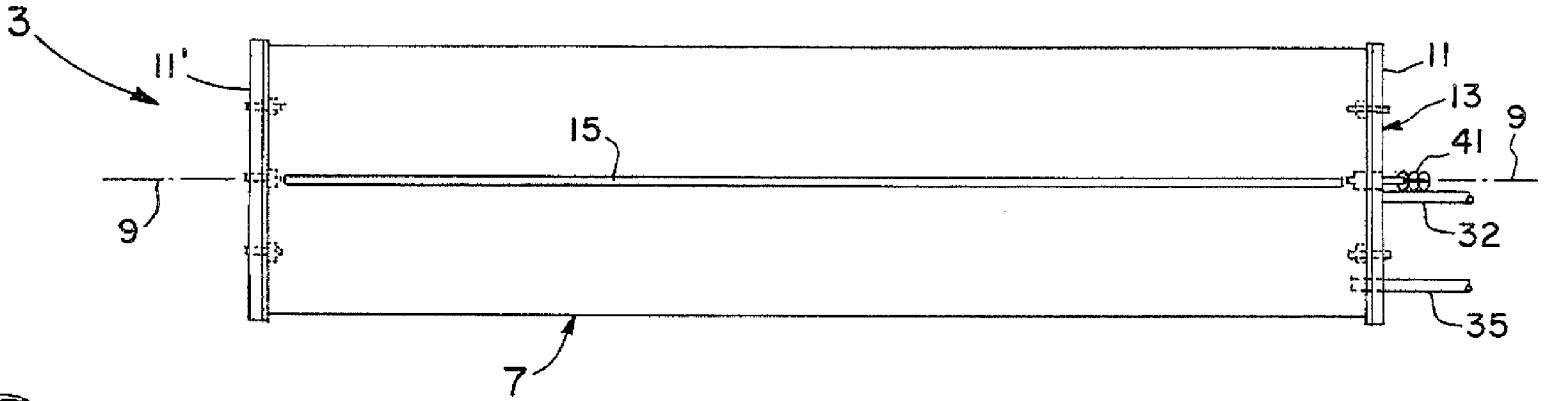
FIG. 6 is a top plan view of the driving unit.
Figure 7:
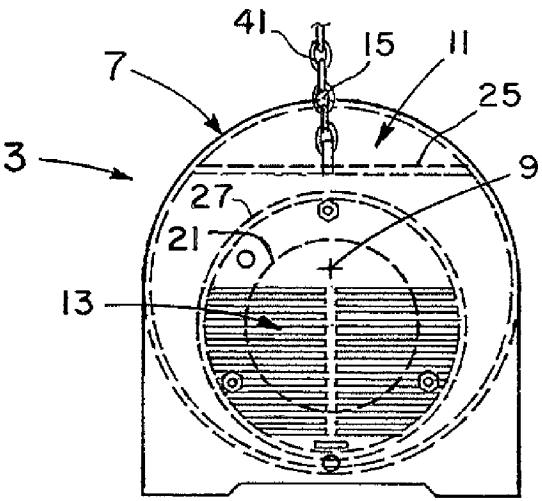
FIG. 7 is an end view of the driving unit.
Figure 5:
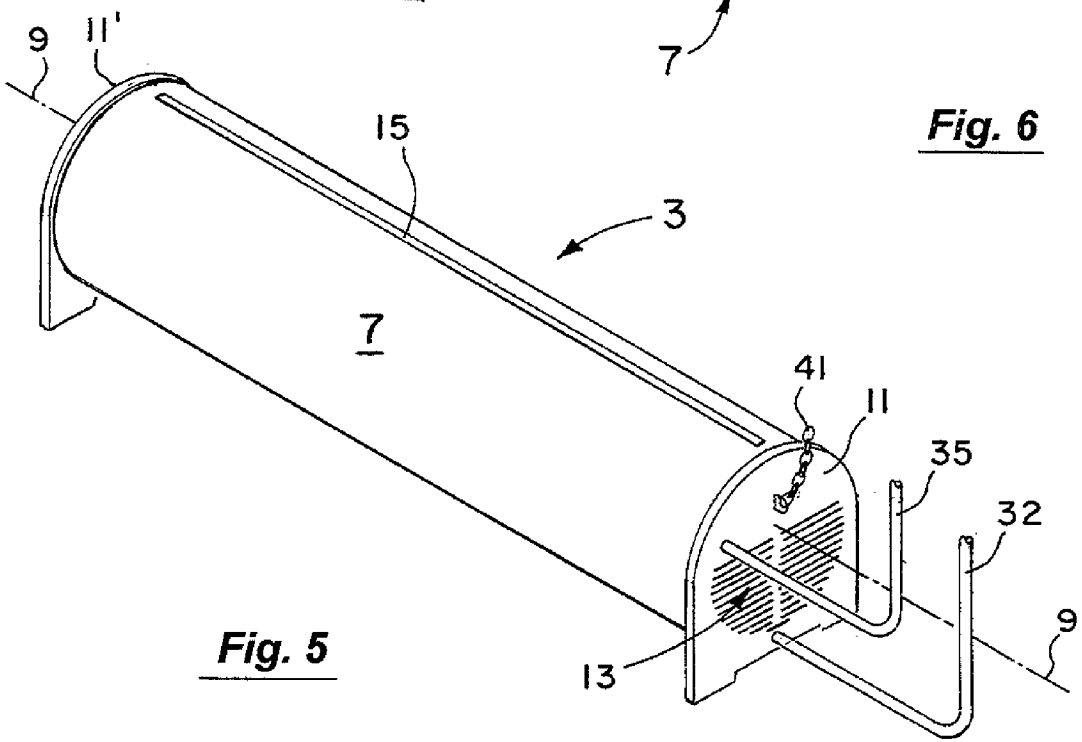
FIG. 5 is a perspective view of the driving unit of the circulation system.

The driving unit 3 itself as shown in FIGS. 5-7 has an outer shell 7 that extends along an axis 9 between first and second end portions 11,11'. The shell 7 has at least one inlet at 13 and at least a first outlet at 15. The shell 7 is positionable on the floor 8 of the tank 2 (FIG. 1) with the outlet 15 facing upwardly (see also FIGS. 5-7). The upwardly facing outlet 15 in the preferred embodiment of FIG. 5 is a very thin, elongated slot (e.g., ¼ inch or less wide and 36 inches or so long) that extends substantially along the axis 9 of the shell 7 substantially the entire distance between the end portions 11,11' of the shell 7. The width of the discharge 12 is then less than 5% of its length and preferably more on the order of less than 1%-2% of its length.

Figure 9:
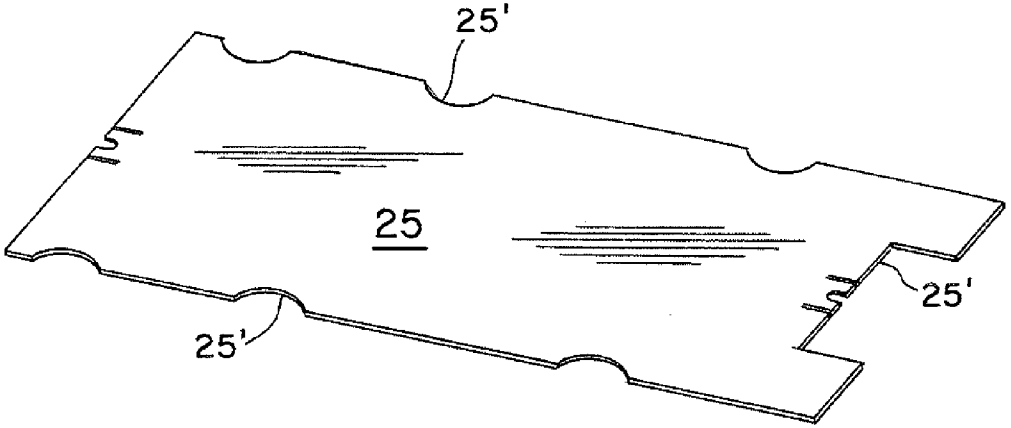
FIG. 9 is a perspective view of the baffle plate positioned inside the driving unit.
Figure 8:
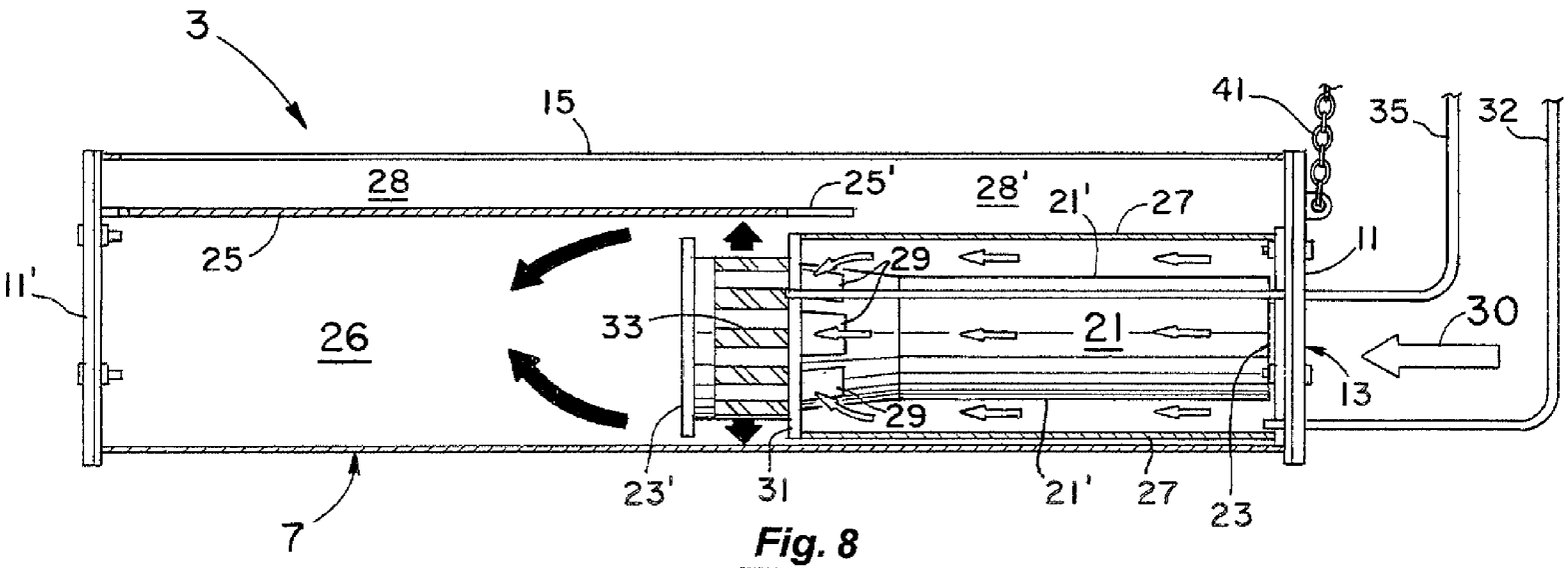
FIG. 8 is a partial cross-sectional view of the driving unit showing its interior components.

Supported within the shell 7 of the driving unit 3 is a pump 21 (see FIG. 8). The pump 21 has first and second end portions 23,23' with the second end portion 23' of pump 21 being preferably spaced from the second end portion 11' of the outer shell 7 in this embodiment. A baffle plate 25 is preferably positioned as illustrated in FIG. 8 to extend within the shell 7 from just above the second end portion 23' of the pump 21 to the second end portion 11' of the shell 7. A small volume of water 26 (e.g., 16 ounces) is then defined between the end portions 23',11' of the pump 21 and shell 7. The baffle plate 25 as shown in FIG. 9 has holes or cutouts 25' to permit water to flow by it to the areas 28,28' in FIG. 8 just below the slot of the outlet 15. The baffle plate 25 in this embodiment has been found to help to evenly distribute the pressurized water (e.g., 5-10 psi above ambient) along the entire length of the slot of outlet 15 in the areas 28,28' between the end portions 11,11' of the shell 7.

In operation, the pump 21 continuously draws an incoming flow of water 30 (see FIG. 2) from outside the driving unit 3 adjacent the tank floor 8. The incoming water 30 flows axially through the inlet 13 (see also FIG. 8) of the shell 7 at its first end portion 11. The water is drawn passed the outside of the pump casing 21' in FIG. 8 between the pump casing 21' and an outer tube 27 into the pump inlets 29 just short of the closed wall 31. The drawn water cools the pump 21 on its path to the inlets 29 and then passes through the pump impeller 33 out into the volume of water at 26 under the baffle plate 25. In this manner, the pump 21 draws and then drives the continuously incoming flow 30 through the shell 7 of the driving unit 3 and out of the driving unit 3 (FIG. 2) through the slot of the upwardly facing outlet 15 in the shell 7 (see also FIG. 5). The slot of the outlet 15 as indicated above is very thin (e.g., ¼ inch or less) and elongated (e.g., 36 inches or more) and creates a very thin (see FIG. 3 at 12), substantially planar (see FIGS. 2-3 in conjunction with each other at 12) discharge of water through the slot of the outlet 15. The thin, substantially planar discharge 12 as shown in FIGS. 2-3 is directed upwardly toward the surface 22 of the body of water 20. As indicated above, the upwardly directed discharge at 12 in turn induces water at 18' in FIG. 3 adjacent the longitudinal or axial outside of the shell 7 of the driving unit 3 to move upwardly with it toward the surface 22 of the body of water 20. The pump 21 is relatively light weight (e.g., 70-80 pounds) and is preferably a relatively small, electric one (e.g., 48 VAC and 500 watts). The pump 21 as shown in FIGS. 1 and 8 has a power line such as 32 dropping down to it from the tank top 6 (FIG. 1) that is adjacent the disinfectant line 35 and lowering chain 41 discussed below.

Figure 10:
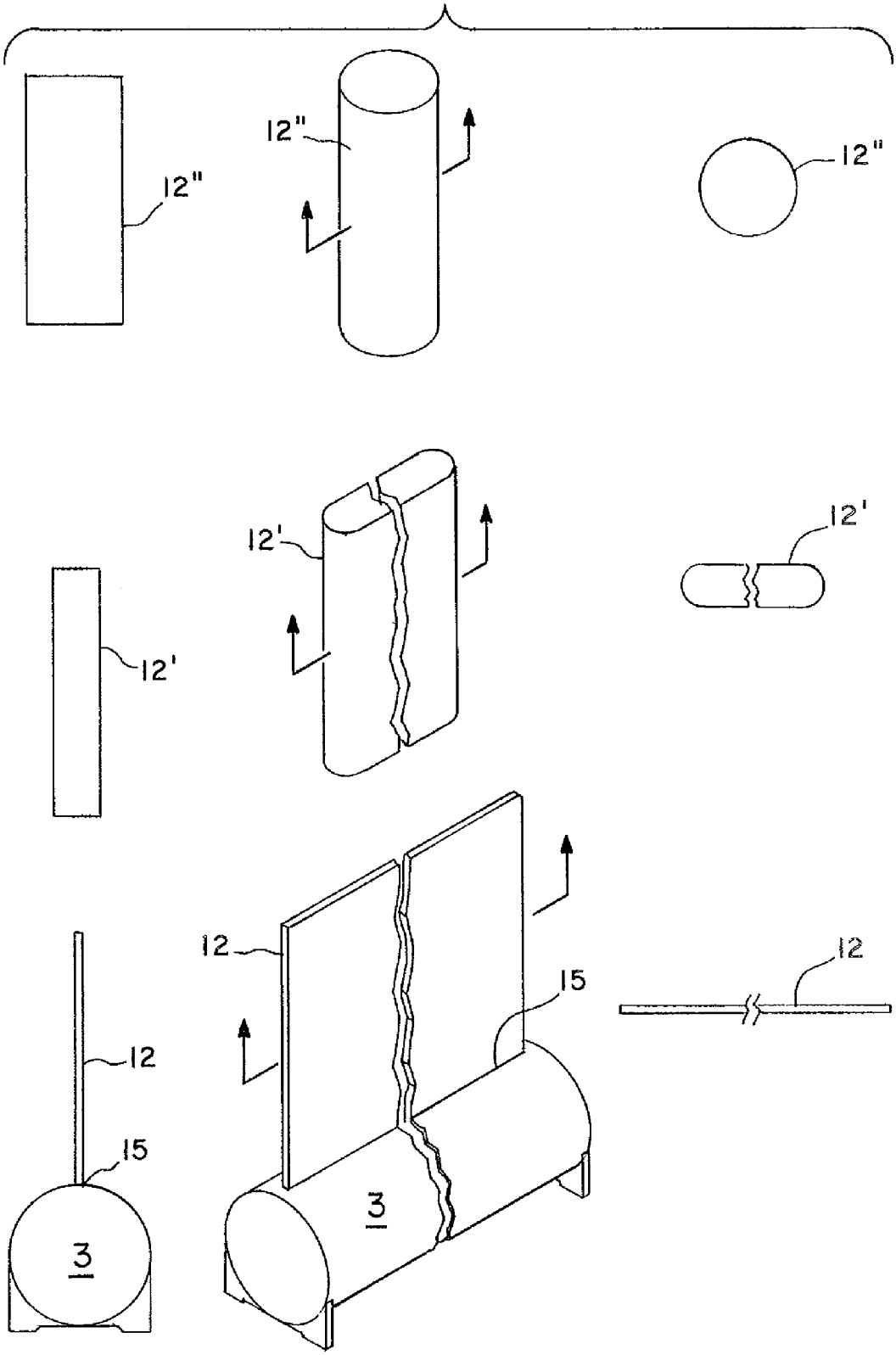
FIG. 10 is a schematic representation of the manner in which the upwardly directed flow from the driving unit is believed to change from an initial, substantially planar flow to an oval one and then to a final, substantially cylindrical flow as it moves upwardly toward the surface of the tank water.

For its volume, the thin, substantially planar discharge at 12 (FIG. 3) presents a very large surface area along its longitudinal sides to the adjacent water and induces a large amount of adjacent water to travel upwardly with it. In doing so, it is believed that as the initial discharge 12 travels upwardly in FIG. 3, the discharge 12 due to the surrounding water it induces as schematically shown in FIG. 10 begins to narrow or close in from its edges and increase in volume from essentially a plane to more of a substantially oval shape at 12' (FIG. 10). Thereafter, it is believed that the upwardly flow 12' continues to narrow or close in from its edges, increase in volume, and thicken more into a substantially cylindrical shape at 12" before reaching the surface 22 of the body of water 20 and crowning at 22' in FIGS. 2-3.

It has been empirically measured that the thin, substantially planar initial discharge 12 (e.g., at 150-200 gallons per minute) will induce an overall flow or movement of water in the tank 2 on the order of 10:1 (e.g., 1500-2000 gallons per minute). This is in comparison to a single nozzle at the same discharge rate and volume inducing or moving flow in the tank 2 at more of a 5:1 ratio. Again, it is believed that the greatly increased surface area of the thin, substantially planar discharge 12 (versus for example the external surface area of a single nozzle creating a substantially cylindrical discharge) contacts and induces the significant difference in overall flow or movement of water in the tank 2. Further, this is accomplished as illustrated in FIGS. 2-3 without sacrificing the desired surface mounding or crowning at 22' and resulting, radial surface spreading of the water as illustrated in FIG. 4.

The essentially non-turbulent discharge 12,12',12" and surface crowning at 22' in FIGS. 2-3 additionally ensures that the overall circulation pattern with 14,16,18 and induced secondary patterns such as 24 in FIGS. 2-3 are all desirably created in a nearly laminar manner for thorough and uniform mixing of all of the water in the entire tank 2. Further and because of the thoroughness of the mixing, it is possible to inject disinfectant (e.g., chlorine) as needed at the driving unit 3 via a line such as 35 in FIGS. 1 and 8 and have the disinfectant be uniformly, reliably, and relatively quickly (e.g., a matter of a few hours) spread throughout all of the water in the tank 2. The disinfectant line 35 in this regard preferably discharges the concentrated disinfectant into the outflow from the pump impeller 33 as shown in FIG. 8 in order to avoid having the concentrated disinfectant pass through the pump 21 itself. Because of the thorough and complete mixing of the water by the circulation system of FIGS. 1-3, the disinfectant is equally mixes throughout the entire tank 2 not only to uniformly disinfect the water but also to contact and disinfect virtually all of the surfaces of the tank 2 below the water line 22. An additional advantage of the uniform mixing of the water is that any sampling of the tank water to monitor the need to add disinfectant or to draw a sample for testing that sufficient disinfectant is present can be reliably done at virtually any location in the tank 2.

As mentioned above, the driving unit 3 of the present invention has been specifically designed to fit through the access opening 10 of the tank 2 (FIGS. 11-13) even when the opening 10 is on the order of 12 inches or less. In this regard and even though the driving unit 3 preferably has an overall length L in FIG. 11 on the order of 36 inches or more to create the desired, elongated, discharge slot at the outlet 15, the height H and width W (FIG. 12) of the driving unit 3 are more on the order of 9.5 and 9.0 inches respectively. As also mentioned above, the driving unit 3 with the attached chain or other flexible line 41 in FIGS. 11-13 has been specially designed so the driving unit 3 can be lowered through the access opening 10 to the tank floor 8 (FIG. 13) to automatically assume the desired operating orientation or position with the slot of the outlet 15 facing upwardly. The lowering can be done manually as the driving unit 3 preferably weighs on the order of only 70-80 pounds or a winch can be used if desired. Regardless, the driving unit 3 will drop down to the tank floor 8 with the leading legs or edge portions 43' (FIG. 13) of the second end portion 11' striking the tank floor 8 first. The driving unit 3 will then pivot substantially about the legs or edge portions 43' to assume the predetermined and desired operating orientation with the slot of the outlet 15 facing upwardly.

Figure 11:
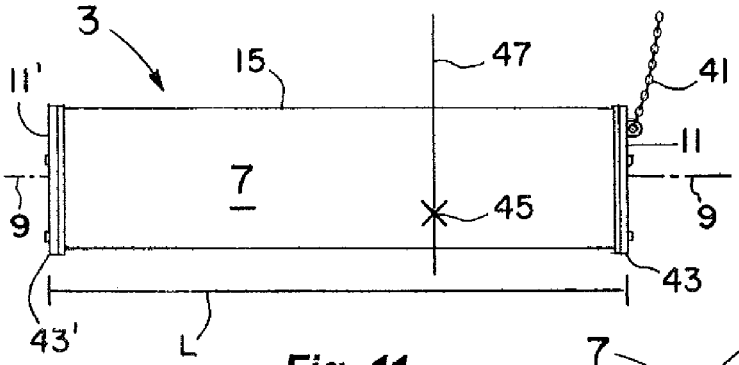
FIGS. 11-13 illustrate views of the driving unit of the circulation system in terms of the location of its center of gravity that permits the lowering technique and positioning of FIG. 13 to be accomplished.
Figure 13:
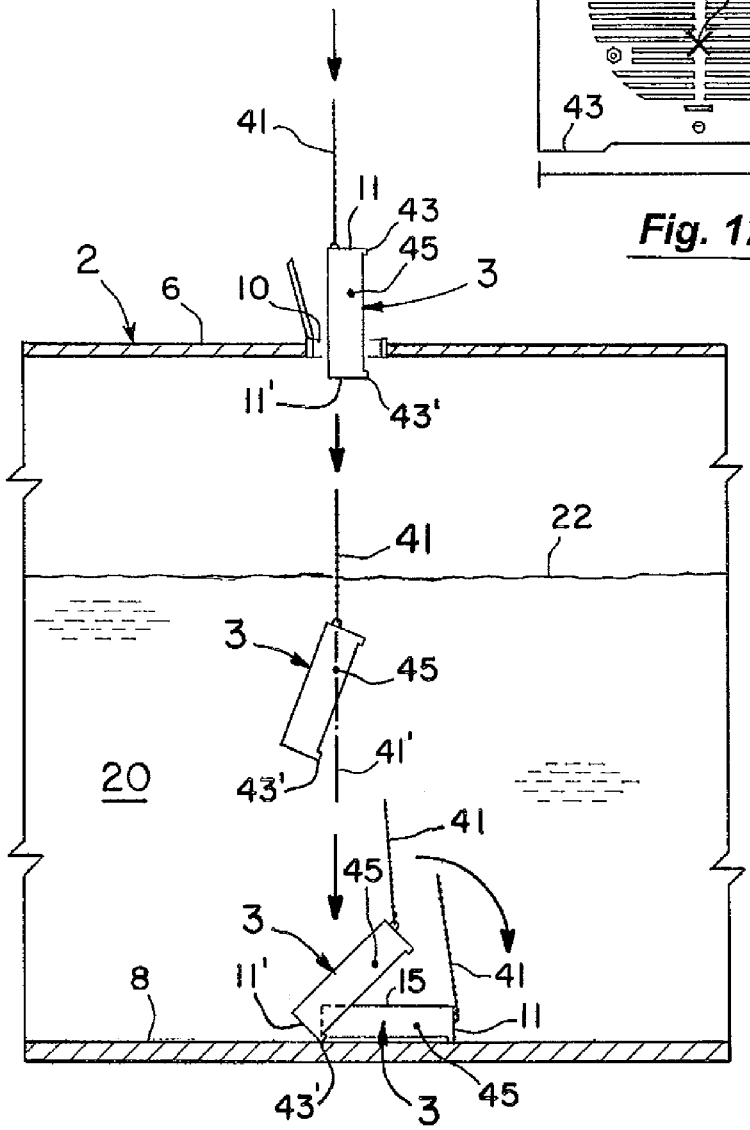

This last feature is accomplished by securing the lowering chain or other line 41 to the driving unit 3 (e.g., at the first end portion 11 of the shell 7 in FIG. 11) above the center of gravity 45 of the driving unit 3 with the driving unit 3 in its operating position of FIG. 11 with the axis 9 of the shell 7 extending substantially horizontally. The chain or other line 41 is also spaced as shown in FIG. 11 laterally to the side of a vertical plane 47 passing through the center of gravity 45 and extending substantially perpendicular to the shell axis 9. The chain 41 is also preferably attached in a second vertical plane substantially perpendicular to the plane 47 and containing the center of gravity 45. Consequently, when the driving unit 3 is lowered as in FIG. 13 with the second end portion 11' of the driving unit 3 preceding the first end portion 11 through the access opening 10, the driving unit 3 will tilt or swing slightly clockwise in FIG. 13 to vertically align the projected axis 41' of the chain 41 and center of gravity 45. In doing so, it will actually move or swing the legs or edge portions 43' of the driving unit 3 slightly to the left in FIG. 13 of the projected axis 41' of the vertically extending chain 41. The legs or edge portions 43' as illustrated in FIG. 13 will then lead the driving unit 3 downwardly to strike the tank floor 8 first. Thereafter, the center of gravity 45 as positioned to the right of the landing legs or edge portions 43' in FIG. 13 will cause the driving unit 3 to pivot substantially about the legs or edge portions 43' (i.e., to the right or clockwise in FIG. 13) to assume the desired operating orientation or position on the tank floor 8 in FIG. 13. It is noted that the legs or edges portions 43' could be a single member if desired. Further, the preferred legs or edge portions 43' are shown as providing relatively sharp edges for the pivoting action but they could be more rounded (e.g., a rounded surface) and could be a single edge portion as discussed above as long as an axially extending edge portion (e.g., sharp or rounded) was preferably provided to facilitate the pivoting action.

Figure 14:
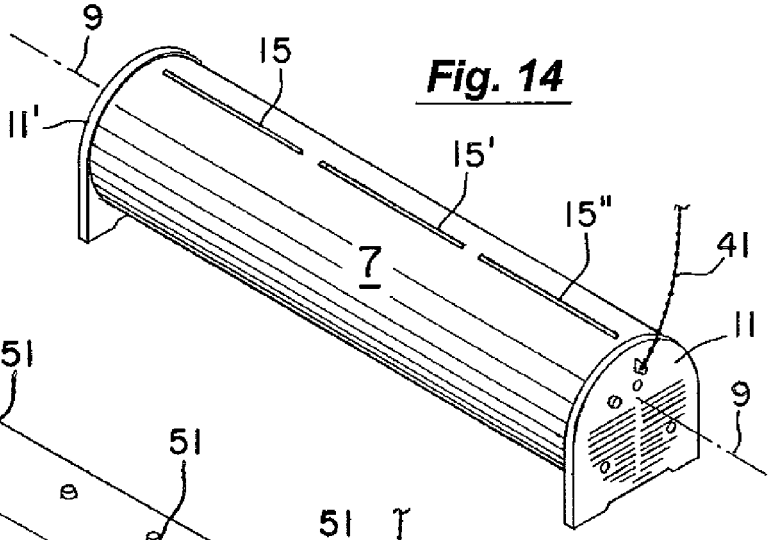
FIG. 14 illustrates a second embodiment of the outlet configuration of the discharge from the driving unit.

It is also noted that the pump 21 and shell 7 of the embodiment of FIGS. 5-8 are set forth as different parts. However, their designs could be combined or integrated with common end portions and a common inlet 13 and/or outlet 15 as long as the slot of the discharge outlet 15 remained thin and elongated. The word shell in this regard is used to refer to the outer element and could be hollow or substantially solid. The single, elongated slot of the outlet 15 of the preferred embodiment of FIGS. 1-13 could also be a series or plurality of immediately adjacent, thin, elongated slots at outlets 15,15', 15" as in FIG. 14. As shown, the slots of the outlets 15,15',15" of FIG. 14 extend along the shell axis 9 and would preferably have the same relative dimensions as that of the outlet 15 in the embodiment of FIGS. 1-13 (i.e., width to length of less than 5% and preferably less than 1%-2%). The combined lengths of the slots of outlets 15,15',15" would also extend substantially the same distance as the shell 7 does between its end portions 11,11'. Although a single, elongated slot is preferred as in the embodiment of FIGS. 1-13, the closely adjacent and substantially collinear ones of 15,15',15" in FIG. 14 will essentially merge just outside of the shell 7 into a single, planar discharge like 12 of the embodiment of FIGS. 1-13.

The outer, tubular shell 7 whether separate from or integral with the pump 21 is also preferably substantially cylindrical along and about the axis 9 as illustrated. This is preferred to provide the maximum, cross-sectional area for its volume so the shell 7 can be as compact as possible and fit through the smaller access openings 10. Additionally, the circulation system of the present invention has been described and illustrated in use in an enclosed, elevated tank but it is equally applicable for use in tanks for ground or underground storage and with other contained bodies of water such as in reservoirs.

Figure 12:
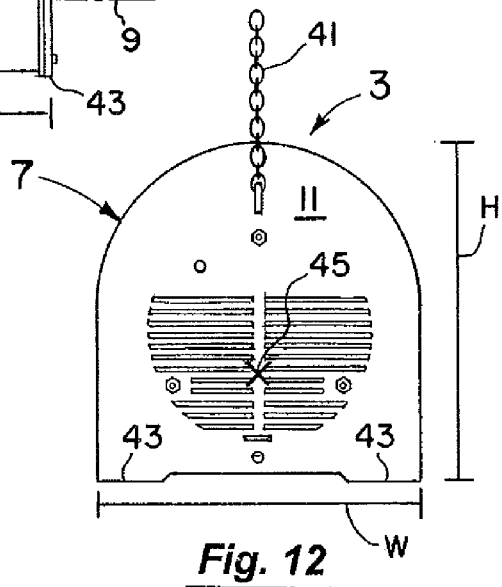
Figure 15A:
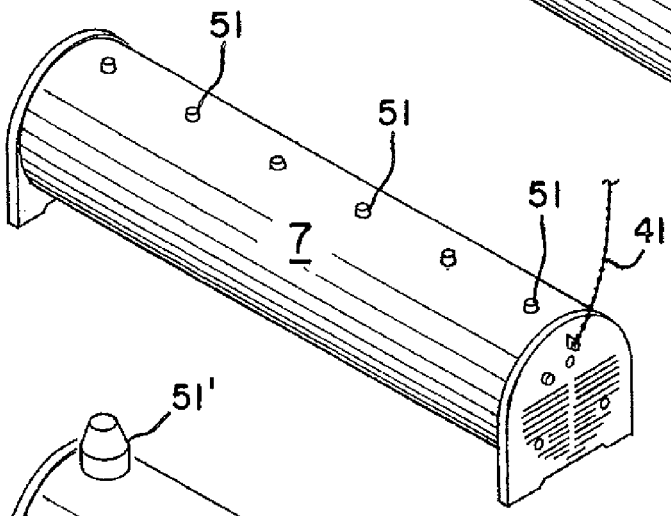
FIGS. 15*a*-15*c* illustrate further discharge arrangements from the driving unit that could be used with the lowering technique of FIG. 13.
Figure 15B:
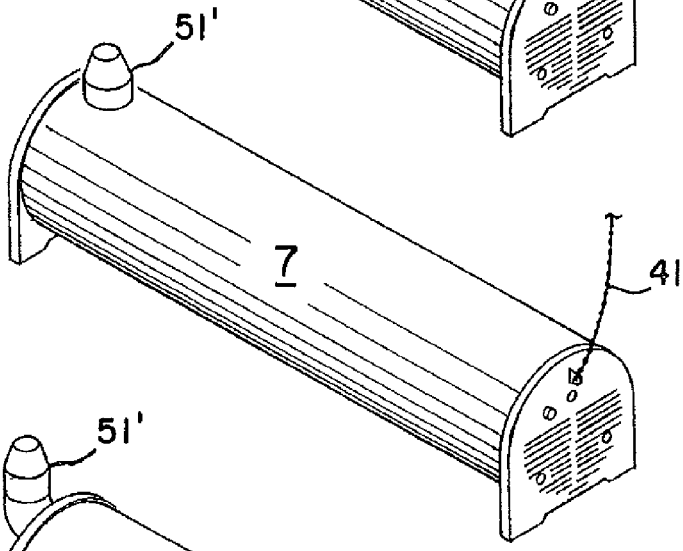
Figure 15C:
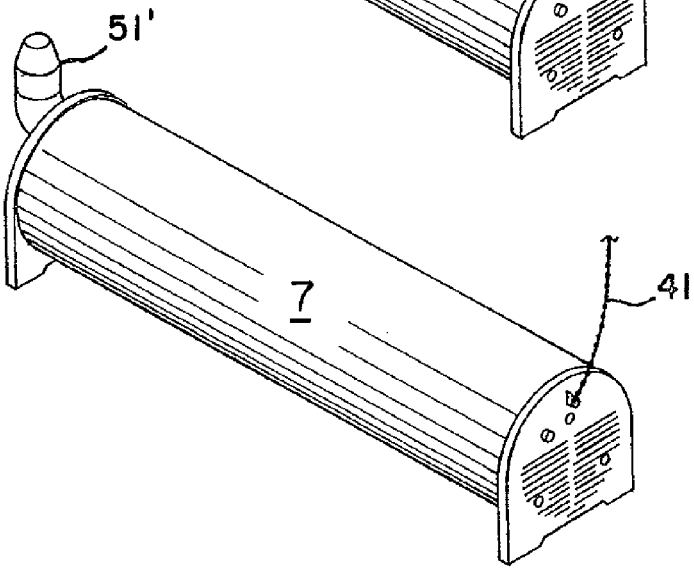

It is further noted that although the discharge arrangements such as the plurality of spaced nozzles 51 of FIG. 15*a* and the single nozzles 51' of FIGS. 15*b* and 15*c* are less preferred than the elongated slots of FIGS. 1-14, these less preferred arrangements can still be used in the lowering technique of FIG. 13. In such cases, the driving unit 3 will still automatically assume the desired operating orientation or position with the discharge nozzles facing upwardly. As in the preferred embodiment of FIGS. 1-13, the tank water is still preferably drawn in axially along the axis 9 of the shell 7 and discharged radially outwardly of the axis 9. The center of gravity 45 in the embodiment of FIGS. 1-13 is positioned as shown in FIGS. 11-13 due primarily to the heaviest component (i.e., the pump 21) being located as illustrated in FIG. 8. However, this location of the center of gravity 45 could be accomplished by simply weighting the shell 7 (whether it is a separate component from the pump 21 or integrated with it) in any fashion to position the center of gravity 45 as illustrated in FIGS. 11-13. The desired lowering technique of FIG. 13 can still be accomplished.

In this last regard, the chain or other flexible line 41 in FIGS. 11-13 could be attached to the shell 7 adjacent to or at the opposite end portion 11' or other locations spaced above the center of gravity 45 (FIG. 11) and from the vertical plane 47 but is preferably attached as shown to the end portion 11. With such an attachment, a large moment arm is created tending to more forcefully pivot the landed driving unit 3 of FIG. 13 about the legs or edge portions 43' to the final, substantially horizontal operating position. The legs or edge potions 43' as discussed above could also be a single member as long as at least one pivoting edge or surface is created.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. A submersible, circulation system (1) for a body of water having a surface (22) and contained in a water tank (2) having side walls (4) and a floor (8), said circulation system including:

a driving unit having a shell (7) extending along an axis (9) and including a pump (21) supported within the shell (7), said shell (7) having at least one inlet (13) and at least a first outlet (15) and being positionable on the floor (8) of the tank (2) with the first outlet (15) facing upwardly; wherein the pump (21) continuously draws an incoming flow (30) of water from outside of the driving unit (3) adjacent the floor (8) of the tank (2) through the inlet (13) of the driving unit (3) with at least a portion of the continuously incoming flow (30) being driven by said pump (21) out of said driving unit (3) through the upwardly facing outlet (15), said upwardly facing outlet (15) being an elongated slot positioned below the surface (22) of the body of water (20) and extending along the axis (9) of the shell (7) of the driving unit (3) and creating a thin, substantially planar discharge (12) of water therethrough below the surface (22) of the body of water (20) and directed upwardly toward the surface (22) of the body of water (20) and inducing water (18') adjacent the outside of the shell (7) of the driving unit (3) along the axis (9) thereof to move upwardly therewith toward the surface (22) of the body of water (20) wherein the shell (7) of the driving unit (3) extends a first distance along said axis (9) between first and second end portions (11,11') and said upwardly facing, elongated slot of the outlet (15) extends along said axis (9) a length substantially equal to said first distance.

2. The circulation system of claim 1 wherein substantially all of the continuously incoming flow (30) is driven by said pump (21) out of the driving unit (3) through the upwardly facing, elongated slot of the outlet (15).

3. The circulation system of claim 1 wherein the upwardly facing, elongated slot of the outlet (15) has a width less than five percent of the length thereof.

4. The circulation system of claim 1 wherein the upwardly facing, elongated slot of the outlet (15) has a width less than two percent of the length thereof.

5. The circulation system of claim 1 wherein the upwardly facing, elongated slot of the outlet (15) has a width less than one percent of the length thereof.

6. The circulation system of claim 1 wherein the inlet (13) of said shell (7) faces longitudinally along the axis (9) and the outlet (15) thereof faces radially outwardly of the axis (9) wherein the continuously incoming flow (30) enters the shell (7) along the axis (9) through the inlet (13) and is driven by said pump (21) radially outwardly therefrom through said outlet (15).

7. The circulation system of claim 6 wherein the shell (7) of said driving unit (3) is elongated and substantially tubular and extends along and about the axis (9) between first and second end portions (11,11').

8. The circulation system of claim 1 further including a line (35) extending from above the surface (22) of the body of water (20) in the tank (2) to the driving unit (3) to deliver disinfectant thereto.

9. The circulation system of claim 1 wherein the tank (2) has a top wall (6) with a relatively small access opening (10) to receive the driving unit (3) therethrough and wherein the shell (7) extends along the axis (9) between first and second end portions (11,11'), said driving unit (3) having a center of gravity (45) and being positionable in a first position with the axis (9) of the shell (7) extending substantially horizontally, said circulation system further including a flexible line (41) attached to said driving unit (3) adjacent the first end portion of the shell (7) above the center of gravity (45) with the driving unit (3) in said first position and attached laterally to the side of a substantially vertical plane (47) passing through the center of gravity (45) and substantially perpendicular to the axis (9) of the shell (7) wherein said driving unit (3) can be lowered through the access opening (10) of the top wall (6) of the tank (2) by said flexible line (41) with the driving unit (3) in a second position with the axis (9) of the shell (7) extending substantially vertically and the second end portion (11') thereof preceding the first end portion (11) thereof toward the floor (8) of the tank (2) and wherein the second end portion (11') of the shell (7) will strike the floor (8) of the tank (2) first and the driving unit (3) pivot about the second end portion (11') to set the first end portion (11) of the shell (7) on the floor (8) with the driving unit (3) in said first position.

10. The circulation system of claim 9 wherein the flexible line (41) is attached to the first end portion (11) of the shell (7).

11. The circulation system of claim 9 wherein the second end portion (11') of the shell (7) includes at least one edge portion (43') extending substantially horizontally with the driving unit (3) in said first position and said second end portion (11') strikes the floor (8) substantially at said edge portion (43') and the driving unit (3) substantially pivots about said edge portion (43') to assume said first position.

12. The circulation system of claim 9 wherein the center of gravity (45) of the driving unit (3) is positioned along the axis (9) closer to the first end portion (11) of the shell (7) than to the second end portion (11') thereof.

13. A submersible, circulation system (1) for a body of water having a surface (22) and contained in a water tank (2) having side walls (4) and a floor (8), said circulation system including:

a driving unit having a shell (7) extending along an axis (9) between first and second end portions (11,11') of the shell (7) and including a pump (21) supported within the shell (7), said shell (7) having at least one inlet (13) and at least a first outlet (15) and being positionable on the floor (8) of the tank (2) with the first outlet (15) facing upwardly; wherein the pump (21) continuously draws an incoming flow (30) of water from outside of the driving unit (3) adjacent the floor (8) of the tank (2) through the inlet (13) of the driving unit (3) with at least a portion of the continuously incoming flow (30) being driven by said pump (21) out of said driving unit (3) through the upwardly facing outlet (15), said shell (7) having an exterior wall with an outer surface with at least a portion of said outer surface extending along said axis (9) substantially between said end portions (11,11') below the surface (22) of the body of water (20), said upwardly facing outlet (15) being an elongated slot through said exterior wall and terminating substantially at and flush with the outer surface of the portion thereof creating a thin, substantially planar discharge (12) of water from the shell (7) into the body of water (20) at the outer surface of the portion thereof directed upwardly toward the surface (22) of the body of water (20) and inducing water (18') adjacent the outside of the shell (7) of the driving unit (3) along the axis (9) thereof to move upwardly therewith toward the surface (22) of the body of water (20) wherein said shell (7) has a plurality of upwardly facing outlets formed by a plurality of elongated slots extending adjacent one another along the axis (9) of the shell (7), said shell (7) extending a first distance along said axis (9) between said first and second end portions (11,11') and the plurality of elongated slots combined extending along said axis (9) a combined length substantially equal to said first distance.

14. The circulation system of claim 13 wherein the slots of said plurality of outlets extend substantially collinearly with each other along said axis (9).

15. A submersible, circulation system (1) for a body of water having a surface (22) and contained in a water tank (2) having side walls (4) and a floor (8), said circulation system including:

a driving unit having a shell (7) extending along an axis (9) and including a pump (21) supported within the shell (7), said shell (7) having at least one inlet (13) and at least a first outlet (15) and being positionable on the floor (8) of the tank (2) with the first outlet (15) facing upwardly; wherein the pump (21) continuously draws an incoming flow (30) of water from outside of the driving unit (3) adjacent the floor (8) of the tank (2) through the inlet (13) of the driving unit (3) with at least a portion of the continuously incoming flow (30) being driven by said pump (21) out of said driving unit (3) through the upwardly facing outlet (15), said upwardly facing outlet (15) being an elongated slot extending along the axis (9) of the shell (7) of the driving unit (3) and creating a thin, substantially planar discharge (12) of water therethrough directed upwardly toward the surface (22) of the body of water (20) and inducing water (18') adjacent the outside of the shell (7) of the driving unit (3) along the axis (9) thereof to move upwardly therewith toward the surface (22) of the body of water (20) wherein the inlet (13) of said shell (7) faces longitudinally along the axis (9) and the outlet (15) thereof faces radially outwardly of the axis (9) wherein the continuously incoming flow (30) enters the shell (7) along the axis (9) through the inlet (13) and is driven by said pump (21) radially outwardly therefrom through said outlet (15) and wherein the shell (7) and pump (21) extend between respective first and second end portions (11,23 and 11,23') with the first end portions (11,23) of the shell (7) and pump (21) being substantially adjacent one another and the second end portion (23') of the pump (21) being spaced from the second end portion (11') of the shell (7), said pump (21) having an inlet (29) and an outlet, said outlet of the pump (21) being adjacent the second end portion (23') thereof, said driving unit (3) further including a baffle plate (25) extending within the shell (7) and along the axis (9) thereof from substantially above the outlet of the pump (21) to the second end portion (11') of the shell (7) to define a volume of water (26) between the end portions (11,23') of the shell (7) and pump (21), said baffle plate (25) having holes (25') therethrough for water from the volume (26) to pass upwardly toward the elongated slot of the upwardly facing outlet (15) of the shell (7).

16. A submersible, circulation system (1) for a body of water having a surface (22) and contained in a water tank (2) having side walls (4) and a floor (8), said circulation system including:

a driving unit having a shell (7) extending along an axis (9) and including a pump (21) supported within the shell (7), said shell (7) having at least one inlet (13) and at least a first outlet (15) and being positionable on the floor (8) of the tank (2) with the first outlet (15) facing upwardly; wherein the pump (21) continuously draws an incoming flow (30) of water from outside of the driving unit (3) adjacent the floor (8) of the tank (2) through the inlet (13) of the driving unit (3) with at least a portion of the continuously incoming flow (30) being driven by said pump (21) out of said driving unit (3) through the upwardly facing outlet (15), said upwardly facing outlet (15) being an elongated slot extending along the axis (9) of the shell (7) of the driving unit (3) and creating a thin, substantially planar discharge (12) of water therethrough directed upwardly toward the surface (22) of the body of water (20) and inducing water (18') adjacent the outside of the shell (7) of the driving unit (3) along the axis (9) thereof to move upwardly therewith toward the surface (22) of the body of water (20) and further including a line (35) extending from above the surface (22) of the body of water (20) in the tank (2) to the driving unit (3) to deliver disinfectant thereto wherein said pump (21) has an outlet positioned within the shell (7) of the driving unit (3) and said disinfectant line (35) has an outlet adjacent the outlet of said pump (21), the outlet of the disinfectant line (35) being positioned in the discharge flow from the outlet of said pump (21).

17. A submersible, circulation system (1) for a body of water such as contained in a water tank (2) having side and top walls (4,6) and a floor (8), said circulation system having a driving unit (3) and the top wall (6) of said tank having a relatively small access opening (10) to receive the driving unit (3) therethrough, said driving unit (3) having an elongated shell (7) extending along an axis (9) between first and second end portions (11,11') of the elongated shell (7), said driving unit (3) further including a pump (21) positioned within said shell (7), said driving unit (3) having a center of gravity (45) and being positionable in a first position with the axis (9) of the shell (7) extending substantially horizontally, said circulation system further including a flexible line (41) attached to said driving unit (3) adjacent the first end portion (11) of the shell (7) above the center of gravity (45) with the driving unit (3) in said first position and attached laterally to the side of a substantially vertical plane (47) passing through the center of gravity (45) and substantially perpendicular to the axis (9) of the shell (7) wherein said driving unit (3) can be lowered through the access opening (10) of the top wall (6) of the tank (2) by said flexible line (41) with the driving unit (3) in a second position with the axis (9) of the shell (7) extending substantially vertically and the second end portion (11') thereof preceding the first end portion (11) thereof in an unguided manner other than being suspended from the flexible line (41) toward the floor (8) of the tank (2) and wherein the second end portion (11') of the shell (7) will first strike only the floor (8) of the tank (2) and thereafter the driving unit (3) will pivot on the floor (8) of the tank (2) under only its own weight about the second end portion (11') to set the first end portion (11) of the shell (7) on the floor (8) with the driving unit (3) in said first position.

18. The circulation system of claim 17 wherein the flexible line (41) is attached to the first end portion (11) of the shell (7).

19. The circulation system of claim 17 wherein the second end portion (11') of the shell (7) includes at least one edge portion (43') extending substantially horizontally with the driving unit (3) in said first position and said second end portion (11') strikes the floor (8) substantially at said edge portion (43') and the driving unit (3) substantially pivots about said edge portion (43') to assume said first position.

20. The circulation system of claim 17 wherein the center of gravity (45) of the driving unit (3) is positioned along the axis (9) closer to the first end portion (11) of the shell (7) than to the second end portion (11') thereof.

21. A submersible, circulation system (1) for a body of water having a surface (22) and contained in a water tank (2) having side walls (4) and a floor (8), said circulation system including:

a driving unit having a shell (7) extending along an axis (9) between first and second end portions (11,11') of the shell (7) and including a pump (21) supported within the shell (7), said shell (7) having at least one inlet (13) and at least a first outlet (15) and being positionable on the floor (8) of the tank (2) with the first outlet (15) facing upwardly; wherein the pump (21) continuously draws an incoming flow (30) of water from outside of the driving unit (3) adjacent the floor (8) of the tank (2) through the inlet (13) of the driving unit (3) with at least a portion of the continuously incoming flow (30) being driven by said pump (21) out of said driving unit (3) through the upwardly facing outlet (15), said shell (7) having an exterior wall with an outer surface with at least a portion of said outer surface extending along said axis (9) substantially between said end portions (11,11') below the surface (22) of the body of water (20), said upwardly facing outlet (15) being an elongated slot through said exterior wall and terminating substantially at and flush with the outer surface of the portion thereof creating a thin, substantially planar discharge (12) of water from the shell (7) into the body of water (20) at the outer surface of the portion thereof directed upwardly toward the surface (22) of the body of water (20) and inducing water (18') adjacent the outside of the shell (7) of the driving unit (3) along the axis (9) thereof to move upwardly therewith toward the surface (22) of the body of water (20) wherein the shell (7) of the driving unit (3) extends a first distance along said axis (9) between first and second end portions (11,11') and said upwardly facing, elongated slot of the outlet (15) extends along said axis (9) a length substantially equal to said first distance.

22. The circulation system of claim 21 wherein said portion of said outer surface extends along said axis (9) substantially uniformly between said end portions (11,11').

23. The circulation system of claim 21 wherein the upwardly facing, elongated slot of the outlet (15) has a width less than five percent of the length thereof.

* * * * *